United States Patent [19]

Roosa et al.

[11] 4,259,059

[45] Mar. 31, 1981

[54] EXTENSION LIGHTER

[76] Inventors: Vernon D. Roosa, 184 Wood Pond Rd., West Hartford, Conn. 06107; Peter V. Roosa, 253 Fairview Ave., West Hartford, Conn. 06514

[21] Appl. No.: 66,816

[22] Filed: Aug. 15, 1979

[51] Int. Cl.[3] ..... F23Q 2/00

[52] U.S. Cl. ..... 431/254; 431/345

[58] Field of Search ..... 431/344, 345, 142, 143, 431/130, 131, 150, 254, 276, 277; 126/25 B; 294/19 R; D27/36, 38, 42

[56] References Cited

U.S. PATENT DOCUMENTS

| | | | |
|---|---|---|---|
| 2,581,304 | 1/1952 | Sims | 431/345 |
| 3,827,852 | 8/1974 | Chevallier | 431/254 |
| 3,890,087 | 6/1975 | Jackson | 431/254 |
| 4,013,398 | 3/1977 | Hendrix | 431/344 |
| 4,037,868 | 7/1977 | Baker | 294/19 R |

*Primary Examiner*—Carroll B. Dority, Jr.
*Assistant Examiner*—Lee E. Barrett
*Attorney, Agent, or Firm*—Holland, Armstrong, Wilkie & Previto

[57] ABSTRACT

An extension lighter is described for the ignition of hard to reach material such as fireplaces, grills and the like. A conventional self contained lighter having a switch-on and switch-off control is mounted on an extension comprising a lighter holder and an operating arm or plunger. The lighter is removably mounted on one end of the holder and a trigger grip is provided permitting the user to both ignite and to extinguish the lighter by means of the plunger without directly operating the lighter itself.

17 Claims, 8 Drawing Figures

EXTENSION LIGHTER

This invention relates to lighters and more particularly to an extension or remote lighter for use with fireplaces or grills or with other inaccessible places. More particularly, the invention relates to a novel use of a regular lighter where a lighter is mounted for remote operation on an extension and is ignited and extinguished remotely.

This invention is an improvement upon prior remote ignition devices having elongated extensions or handles. It employs a regular hand-held lighter having a hand operated ignition and extinguishing means. In the extension form of the invention the lighter is both ignited and extinguished remotely without direct hand operation of the lighter. It is an improvement, for example, over previous lighters such as those illustrated in prior U.S. Pat. Nos. 3,138,944, 3,523,005 and 4,013,398. These prior extension lighters were relatively complex and expensive in not being adapted to use the simpler mass-produced hand lighters or they failed to provide for the remote ignition and extinguishing of the lighter where hand-held lighters were adapted for this purpose.

The present extension means and lighter combination preferably utilizes two relatively simple molded plastic elements in combination with a mass-produced butane lighter to provide the remote lighting capability. The extension mountings include a lighter holder and a co-operating plunger both of which are formed as unitary elements molded from a suitable plastic. The completed extension lighter is assembled by a simple snapping together of the holder and the plunger together with the butane lighter.

A hand-held lighter of the butane type is used which has an ignition button or other control which is pressed or otherwise manipulated to ignite the lighter and which is released to extinguish the lighter. For example, one preferred lighter is a lighter having a sliding ignition switch which is pressed for ignition and released to extinguish the lighter and which is manufactured by Feudor Company of 50 Campus Plaza, Edison, N.J. 08817. The advantage of this type of lighter is its ability to be both ignited and extinguished easily in the preferred remote mounting of the invention as described below.

Accordingly, an object of the present invention is to provide an improved remote or extension lighter.

Another object of the present invention is to provide an improved remote lighter utilizing a known butane type hand-held lighter.

Another object of the present invention is to provide an effective and relatively inexpensive mounting means for forming a remote lighter utilizing a conventional hand-held butane type lighter.

Another object of the present invention is to provide a remote lighter which is both ignited and extinguished by remote control.

Another object of the present invention is to provide an inexpensive remotely operated lighter for fireplaces and grills and the like.

Another object of the present invention is to provide a remote type lighter having an easy replaceable lighter element.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
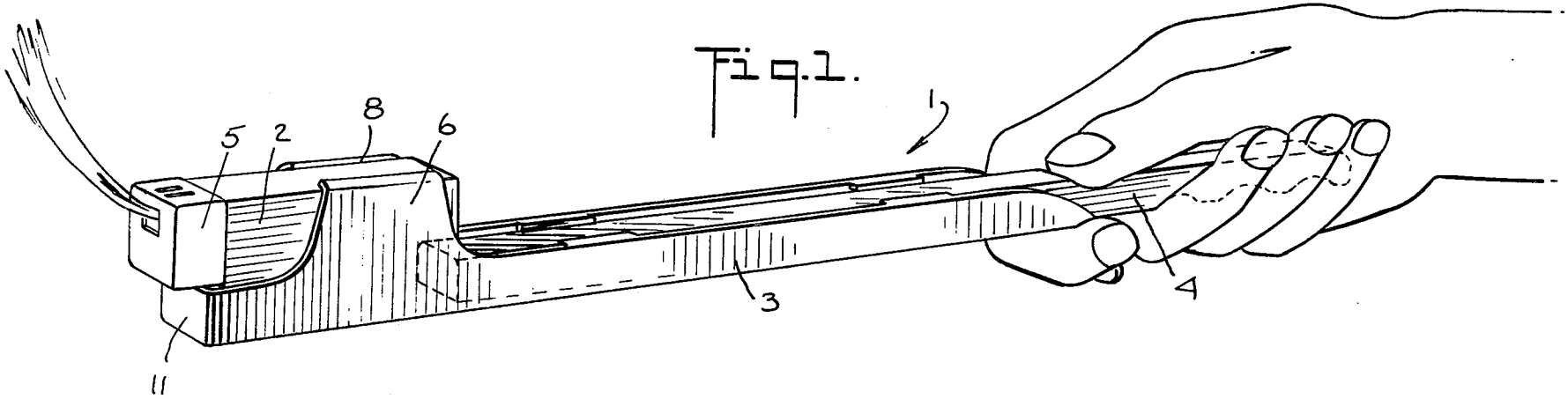
FIG. 1 is a perspective view of the assembled extension lighter in use.
Figure 2:
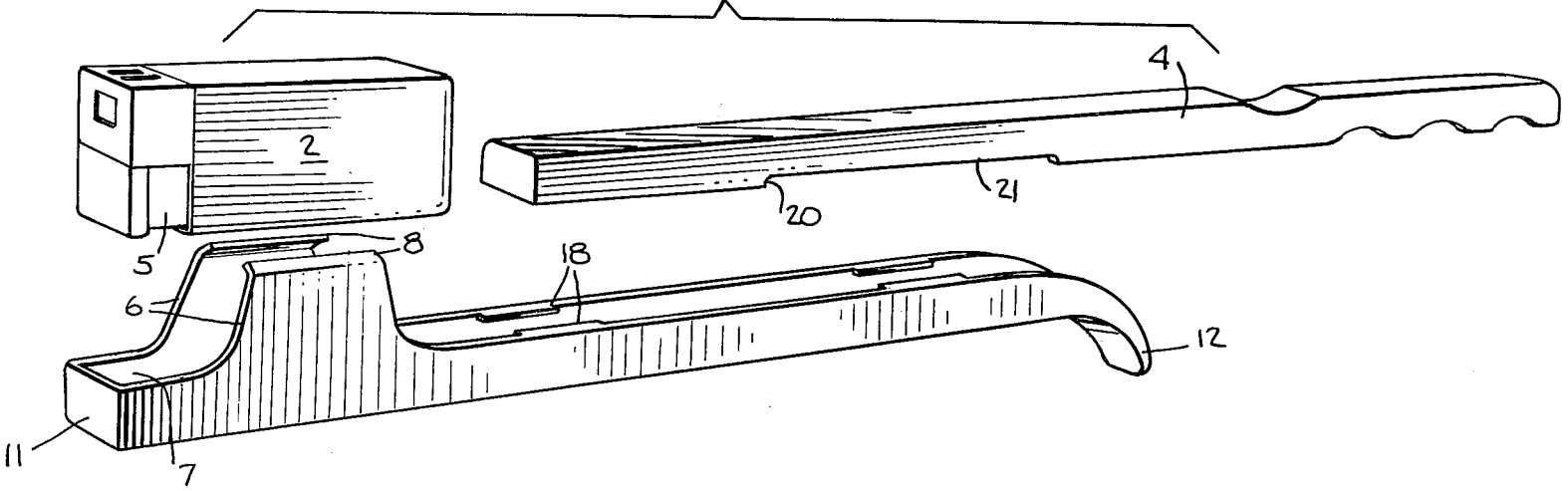
FIG. 2 is an exploded perspective view of the extension lighter of FIG. 1.

FIG. 1 illustrates the assembled extension lighter 1 in use. It comprises a butane type hand-held lighter 2 mounted in a lighter holder 3 and which is operated by a plunger 4 slidably positioned on the holder 3.

The hand-held lighter 2 is of the butane type. Such lighters are commercially available in a form which includes a supply of butane fuel supplying a wick which is ignited by a movable ignition button 5 to strike a flint. The preferred butane type lighter 2 has a slidable ignition button 5 which is pressed downwardly for ignition and which is released for extinguishing the lighter. This button is spring loaded so that it is depressed to ignite the lighter 2 against the force of a spring means which returns the button 5 and extinguishes the lighter when the button is released. The exact details of the lighter ignition are not part of the present invention as such lighters are available with the suitable spring loaded ignition and extingushing mechanisms as shown in U.S. Pat. No. 3,827,852 of Aug. 6, 1974, for example.

The lighter holder 3 of the present invention has a spring-like lighter gripping or retaining clip 6 with inwardly directed retaining lips 8 at its end which permits the lighter 2 to be snapped into place within the hollow outer end 7 of the holder 3. In its preferred form the holder 3 is a unitary molded member formed of medium impact polystyrene or a similar easily molded plastic. The holder 3 has a channel-like upwardly opening shape including a bottom wall 9, opposed side walls 10, and a lighter retaining end wall 11. Additionally, the inner end of the holder 3 has a curved trigger grip 12 which is used in operating the extension lighter 1 as will be further described below.

Figure 3:
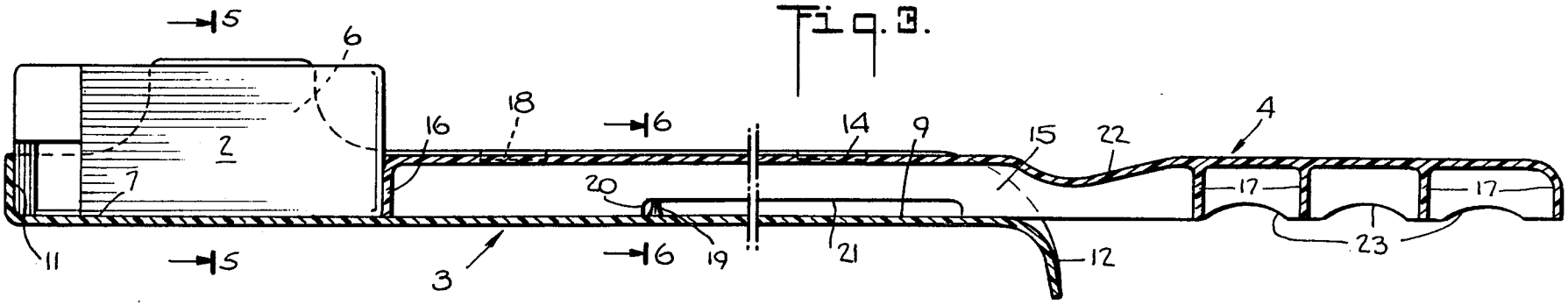
FIG. 3 is a side elevational view partially in section of the extension lighter.
Figure 8:
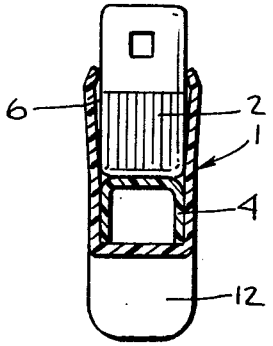
FIG. 8 is a vertical sectional view taken along line 8—8 on FIG. 7.

The plunger 4, which is used in operating the extension lighter 1 is also preferably molded as a unitary member from a similar plastic. It has a channel form including a top wall 14, spaced side walls 15 and an end wall 16. Lateral reinforcing members 17 are supplied at the gripping or inner end. The cross sectional dimensions of the plunger 4 are proportioned so that the plunger 4 fits slidably within the hollow holder 3 with the top wall 14 of the plunger being slidably retained beneath a pair of spaced detents 18 on the holder 3. A detent 19 is positioned on the bottom wall 9 of the holder 3 to engage the outer end 20 of a pair of elongated slots 21 formed in the side walls 15 of the plunger 4 to hold the plunger 4 in its normal or extinguished position as shown in FIG. 3. A rounded thumb grip 22 is provided on the top wall 14 of the plunger 4 and three suitably shaped finger grips 23 are formed on the opposite lower edges of the plunger 4 side walls 15. The extension lighter 1 grip, as illustrated in FIG. 1, provides for relative motion between the holder 3 and the plunger 4 as the lighter 2 is pressed outwardly to activate the lighter button 5.

The lighter clip 6 at the outer end of the holder 3 is relatively flexible because of the inherent flexbility of the preferred plastic and is spaced apart at its top or outer portion to be slightly closer than the width of the lighter 2 thereby providing a tight mounting grip on the lighter 2.

As the plunger 4 is moved forwardly of the holder 3 and against the lighter 2, the lighter 2 is also forced forwardly of the holder 3 causing a relative downward movement of the lighter button 5 on the lighter 2 thereby igniting the butane type lighter (FIGS. 1 and 14). When moved to this position against an internal spring means, the lighter 2 tends to urge the plunger 4 rearwardly of the holder 3. This permits the lighter 2 to be extinguished by the return movement of the lighter button 5 as soon as the user releases his grip on the trigger 12.

Figure 7:
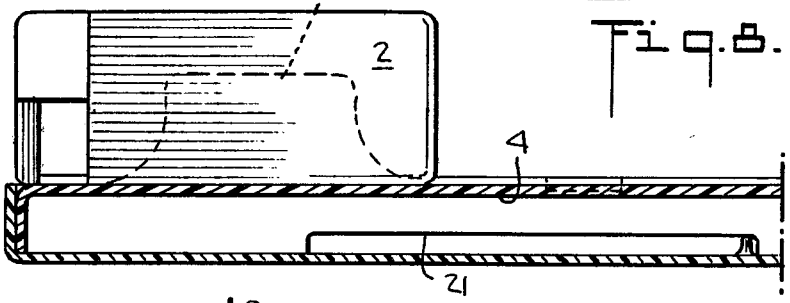
FIG. 7 is a side elevational view of the extension lighter with its parts assembled for shipment.
Figure 6:
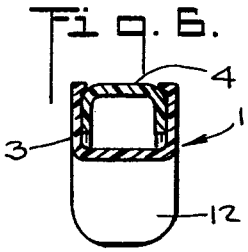
FIGS. 5 and 6 are vertical sectional views taken along lines 5—5 and 6—6 on FIG. 3.
Figure 5:
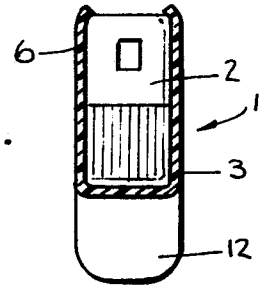
Figure 4:
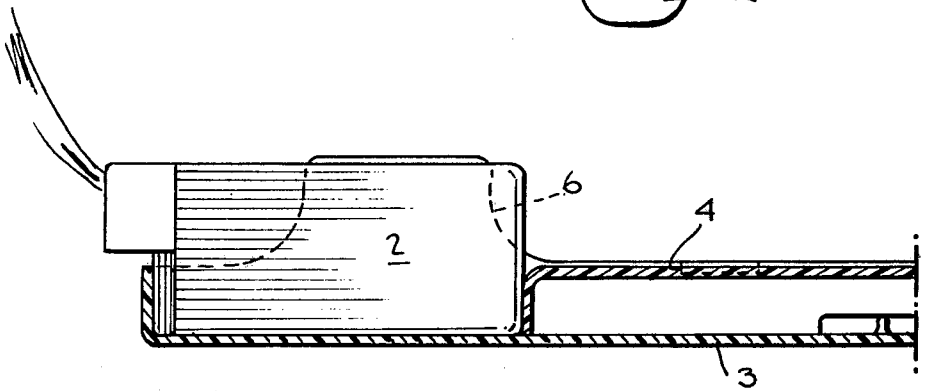
FIG. 4 is a side elevational view of the lighter end portion in its ignited position.

As seen in FIG. 7, the plunger 4 and slot 21 are proportioned so that the plunger 4 may slide forwardly into the normal lighter compartment for the packaging of the extension lighter 1. This provides a double advantage by reducing the overall length of the packaged lighter 1 and by preventing unintentional ignition, as the button 5 is displaced in this position from it usual ignition position as described above.

It will be seen that an improved extension lighter has been provided which is remotely ignited and extinguished and which employs a commercially available hand lighter in obtaining this improved result. The overall combination requires only two relatively inexpensively and easily molded plastic elements in addition to the hand lighter and the extension lighter is safely and easily packaged for shipment in a compact form.

As various changes may be made in the form, construction and arrangement of the parts herein without departing from the spirit and scope of the invention and without sacrificing any of its advantages, it is to be understood that all matter herein is to be intrepreted as illustrative and not in a limiting sense.

Having thus described our invention, we claim:

1. An extension lighter for remote ignition comprising the combination of:

a lighter having a movable means for ignition and for being extinguished;

said movable means comprising a movably mounted member adapted for movement in one direction for ignition and being spring loaded for movement in the opposite direction for extinguishing;

an elongated holder having means for removably mounting said lighter at an outer end, means engaging said movable means for slideably mounting a plunger; and an elongated plunger slidably mounted on said holder with its outer end in engagement with said lighter, whereby relative movement between said lighter and its said movable means results from relative movement of said holder and said plunger.

2. The extension lighter as claimed in claim 1 in which said ignition means on said lighter comprises a button mounted for sliding movement in one direction for lighter ignition against the force of a spring member and for movement in the opposite direction by said spring when being extinguished.

3. The extension lighter as claimed in claim 2 in which said plunger engages and moves the lighter while said button is held stationary by said holder in providing said relative motion of said ignition button.

4. The extension lighter as claimed in claim 1 in which said holder and said plunger comprise hollow molded members proportioned for being nested together in sliding relationship.

5. The extension lighter as claimed in claim 4 in which detents are provided on one of said hollow molded members for holding them together in sliding relationship.

6. The extension lighter as claimed in claim 4 in which said holder includes a rounded finger grip on its inner end.

7. The extension lighter as claimed in claim 6 in which said plunger comprises a plurality of rounded finger grip indents.

8. The extension lighter as claimed in claim 6 in which said plunger comprises a rounded thumb grip on its upper surface.

9. The extension lighter as claimed in claim 1 in which said lighter support means comprises upstanding and spaced resilient unitary molded plastic lighter gripping members.

10. In an extension lighter for remote ignition using a lighter having a movable means for ignition and for being extinguished, the combinatin of:

an elongated holder having means for removably mounting said lighter at an outer end, means for engaging said movable means and means for slideably mounting a plunger;

an elongated plunger slidably mounted on said holder with its outer end in engagement with the lighter, whereby relative movement between said lighter and its said movable means results from relative movement of said support handle and said plunger.

11. The extension lighter as claimed in claim 10 in which said holder and said plunger comprise hollow molded members proportioned for being nested together in sliding relationship.

12. The extension lighter as claimed in claim 11 in which detents are provided on one of said molded members for holding them together in sliding relationship.

13. The extension lighter as claimed in claim 10 in which said holder includes a rounded finger grip on its inner end.

14. The extension lighter as claimed in claim 10 in which said plunger arm comprises a plurality of rounded finger grip indents.

15. The extension lighter as claimed in claim 10 in which said plunger further comprises a rounded thumb grip on its upper surface.

16. The extension lighter as claimed in claim 10 in which said holder lighter mounting means comprises upstanding and spaced resilient unitary molded plastic lighter gripping means.

17. The extension lighter as claimed in claim 11 in which said molded members are proportioned for being moved together in a slipping position beneath the lighter.

* * * * *